US006371803B1

(12) United States Patent
Fan

(10) Patent No.: US 6,371,803 B1
(45) Date of Patent: Apr. 16, 2002

(54) ELECTRICAL CONNECTOR HAVING BOARDLOCK FOR SECURING THE ELECTRICAL CONNECTOR TO A PRINTED CIRCUIT BOARD

(75) Inventor: Chia Hao Fan, Shu-Lin (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/752,890

(22) Filed: Dec. 28, 2000

(30) Foreign Application Priority Data

Sep. 29, 2000 (TW) ..... 89216961 U

(51) Int. Cl.[7] ..... H01R 13/73
(52) U.S. Cl. ..... 439/570; 439/573
(58) Field of Search ..... 439/108, 563, 439/564, 567, 569–573

(56) References Cited

U.S. PATENT DOCUMENTS 5,395,265 A * 3/1995 DiMondi et al. ..... 439/566
6,074,249 A * 6/2000 Beken et al. ..... 439/567
6,089,883 A * 7/2000 McHugh et al. ..... 439/108
6,095,824 A * 8/2000 McHugh ..... 439/108
6,227,906 B1 * 5/2001 Fan ..... 439/570

* cited by examiner

*Primary Examiner*—Hien Vu
(74) *Attorney, Agent, or Firm*—Wei Te Chung

(57) ABSTRACT

A modular jack connector (10) for mounting on a printed circuit board comprises a housing (12) and a pair of boardlocks (20). The housing has a board-mounting face (17) and two opposite side faces (18) connected with the board-mounting face. A groove (36) is defined in each side face, and extends from the board-mounting face. Each boardlock has a retaining portion (22) which is interferentially retained in a corresponding groove. A base portion (24) vertically connects with the retaining portion and has a post (27) downwardly protruding for engaging with the circuit board. Two wings extend upwardly from each base portion for abutting the board-mounting face of the housing. A pair of projections (25) extends downwardly from opposite sides of the retaining portion, and a gap (28) is defined between the base portion and each projection.

7 Claims, 3 Drawing Sheets

ELECTRICAL CONNECTOR HAVING BOARDLOCK FOR SECURING THE ELECTRICAL CONNECTOR TO A PRINTED CIRCUIT BOARD

BACKGROUND OF THE INVENTION

1. Field of the Invention

The present invention relates to an electrical connector, and particularly to an RJ-11 modular jack connector with a boardlock which can secure the RJ-11 modular jack connector to a printed circuit board.

2. Description of the Prior Art

A solderable boardlock commonly attaches to the side of an electrical connector and has a foot at a bottom thereof for extending through and being soldered to a printed circuit board, thereby firmly securing the connector to the printed circuit board. The trend toward miniaturization of electrical devices, favors reducing the area on a printed circuit board occupied by such electrical connectors. Solderable boardlocks for electrical connectors are known which have the solder foot disposed beneath the electrical connector body. U.S. Pat. No. 6,042,420 discloses such an electrical connector having boardlocks with a minimal footprint. Although this electrical connector overcomes some disadvantages, there are still other problems to be solved. For example, the boardlocks are assembled to a bottom of the housing of the electrical connector from lateral sides of the housing in a horizontal direction and are fixed on the housing by an interfering force. The interfering force is too small to meet the requirements for securely retaining the boardlock to the housing.

Furthermore, the horizontal assembling manner is not convenient, making assembly inefficient.

Hence, an improved electrical connector is required to overcome the disadvantages of the prior art.

BRIEF SUMMARY OF THE INVENTION

A first objective of the present invention is to provide a modular jack connector with solderable boardlocks vertically mounted to sidewalls of a dielectric housing of the modular jack.

A second objective of the present invention is to provide a modular jack connector with solderable boardlocks that can achieve a sufficiently large interferential force with the housing to prevent a separation of the housing and the boardlocks.

A third objective of the present invention is to provide a modular jack connector with solderable boardlocks wherein base portions of the boardlocks used for soldering to a printed circuit board can be reliably maintained in a horizontal plane.

To achieve the above objectives, a modular jack connector mounted on a printed circuit board comprises a housing and a pair of boardlocks. The housing has a bottom board-mounting face for mounting to a printed circuit board, two sides-faces upwardly extending from the board-mounting face, and a cavity for receiving a complementary modular plug therein. A groove is vertically defined in each of the side faces beginning from two sides of the board-mounting face. A plurality of contacts is fixed in the housing, each contact having a contacting section upwardly and rearward extending into the cavity, and a tail section for surface mounting to the printed circuit board. A pair of boardlocks each comprises a retaining portion vertically received in a corresponding groove and having an interferential engagement with the housing and a base portion perpendicularly extending from a lower portion of the retaining portion to a position beneath the board-mounting face. Each boardlock includes a post downwardly extending from the base portion for extending through the printed circuit board, and two wings extending upwardly from both sides of the base portion for abutting against the board-mounting face.

Other objects, advantages and novel features of the invention will become more apparent from the following detailed description of the present embodiment when taken in conjunction with the accompanying drawings.

DETAILED DESCRIPTION OF THE INVENTION

Figure 1:
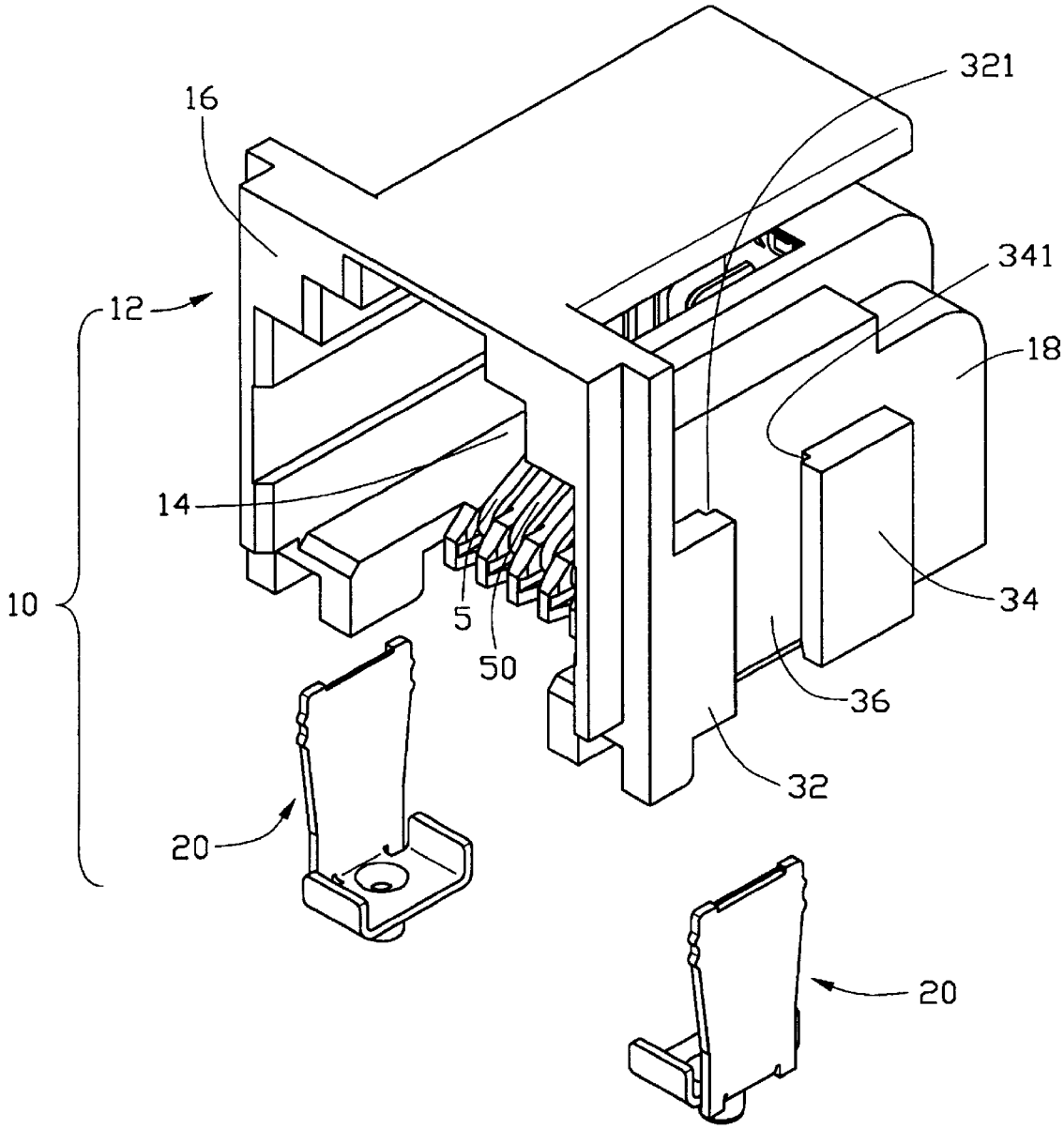
FIG. 1 is a top-front-right isometric view of a modular jack connector according to the present invention with boardlocks separated from a housing of the connector.
Figure 2:
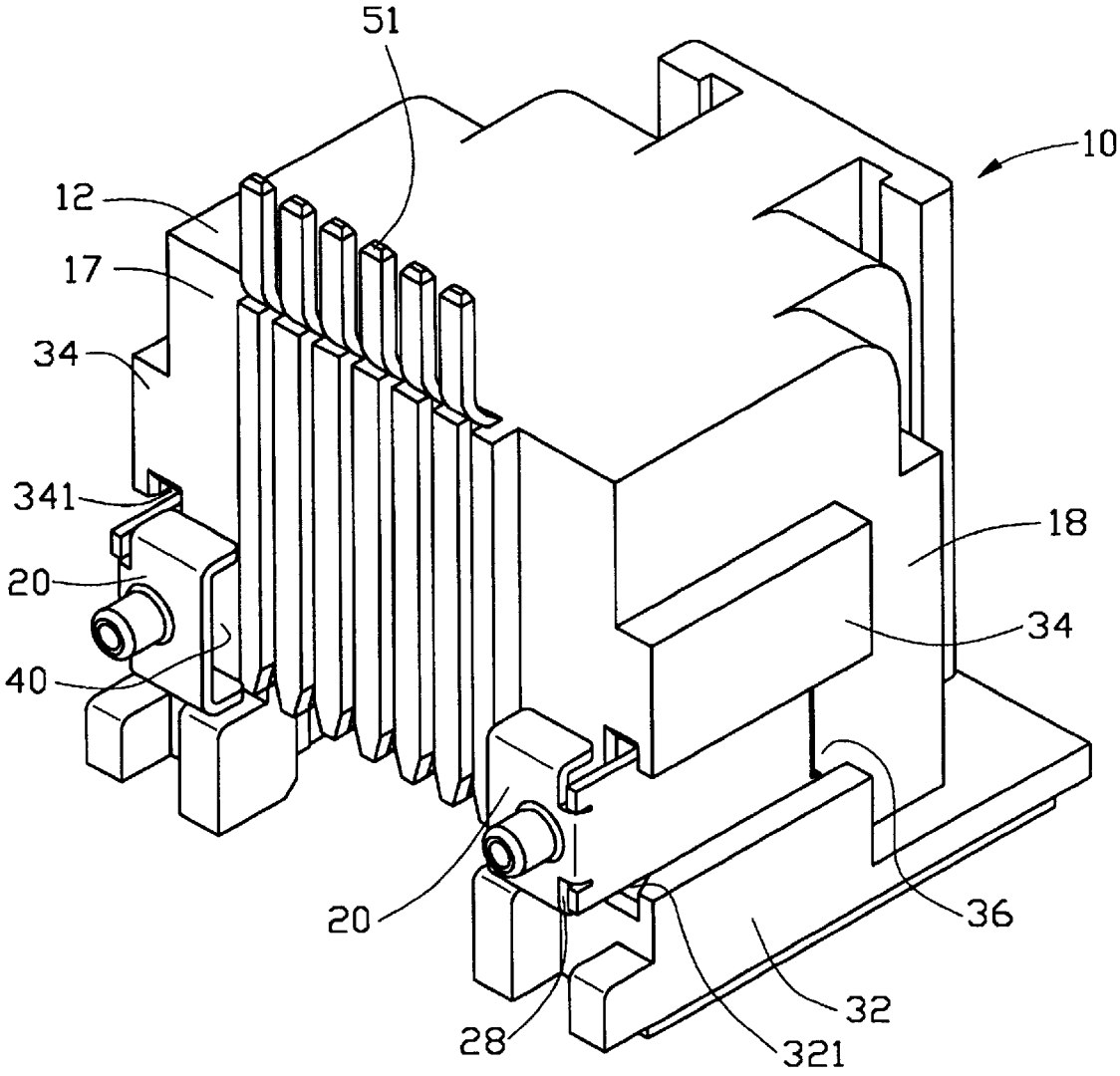
FIG. 2 is a rear-bottom-left isometric view of the electrical connector with boardlocks mounted to the housing of the connector.

Referring to FIGS. 1 and 2, an RJ-11 modular jack connector 10 according to the invention comprises an insulative housing 12 and a pair of boardlocks 20. The housing 12 has a front mating face 16 for mating with a complementary RJ-11 modular plug connector (not shown); a board-mounting face 17 for mounting to a printed circuit board (not shown) two side faces 18, and a top and a rear faces (not labeled). A cavity 14 is defined through the front mating face 16 into the housing 12 and is dimensioned to receive the complementary RJ-11 plug connector. First and second retention blocks 32, 34 are formed vertically along each side face 18 upward from the board-mounting face 17. A groove 36 is vertically defined in each side face 18 between the first and second retention blocks 32 and 34. Each groove 36 has a T-shape when viewed from a top of the housing 12, and includes a central channel and two side channels 321, 341 respectively defined in an inner corner of the first and second retention blocks 32, 34.

The housing 12 fixedly receives a plurality of electrical contacts 5 therein each having a contacting section 50 upwardly and rearwardly extending into the cavity 14 for electrically engaging with the plug connector, and a tail section 51 extending horizontally to the board-mounting face 17 of the connector 10 for soldering to the printed circuit board using surface mounting technology.

Figure 3:
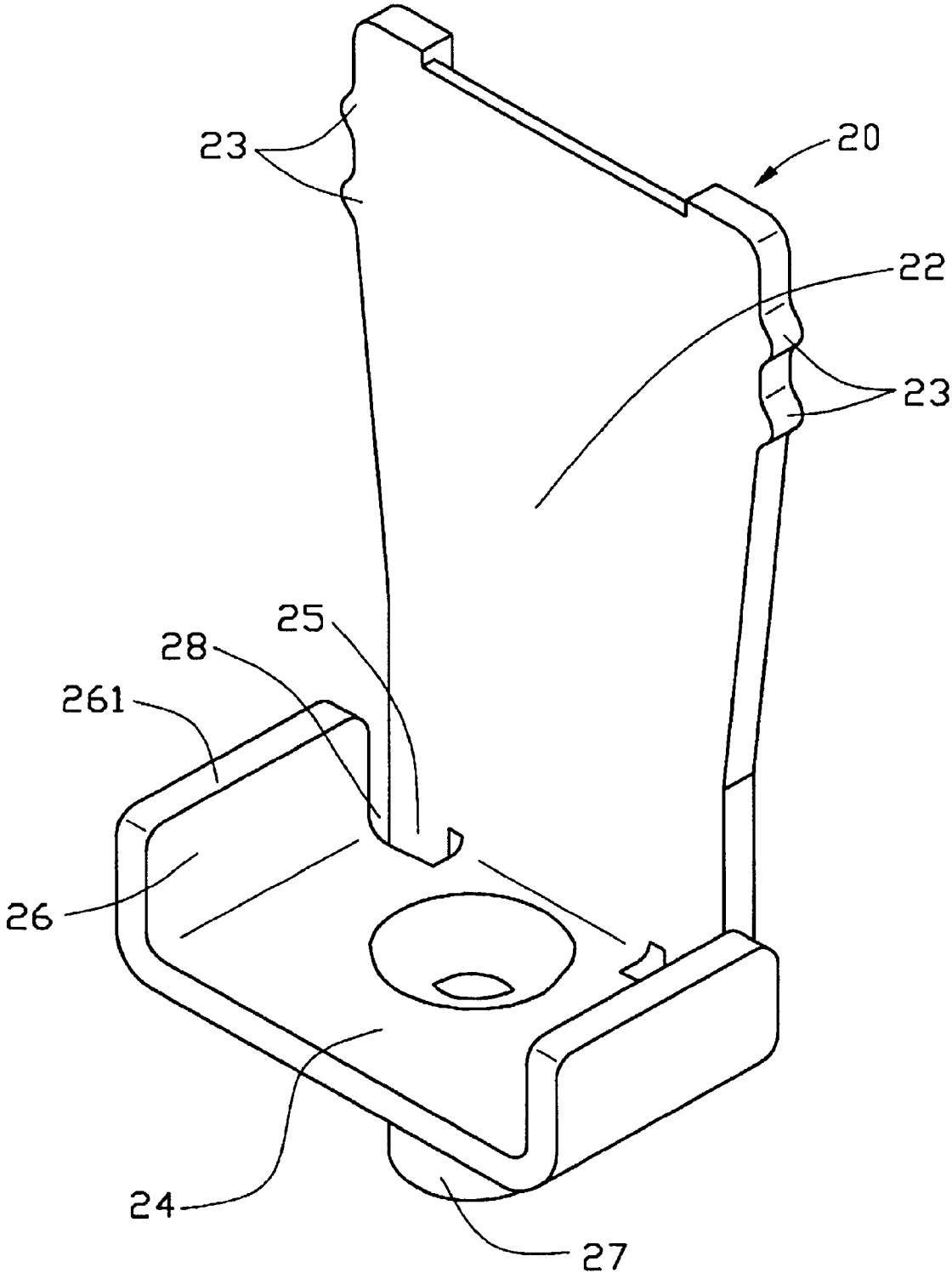
FIG. 3 is an enlarged view of one of the boardlocks.

Also referring to FIG. 3, each of the boardlocks 20 is integrally formed by stamping from metal sheet material. Each boardlock 20 includes an elongate retaining portion 22 and a rectangular base portion 24 perpendicularly extending from a lower edge of the retaining portion 22. The retaining portion 22 is adapted to be mounted in a corresponding groove 36 for retaining the boardlock 20 to the side face 18 of the housing 12. A plurality of barbs 23 is formed on opposite lateral edges of an upper portion of the retaining portion 22. A post 27 protrudes downwardly from a center of a bottom of the base portion 24 for extending through the printed circuit board. At each of opposite sides of the base portion 24, a wing 26 extends upwardly from and vertical to the base portion 24.A top edge 261 is defined at a free end of each wing 26. A pair of projections 25 extends downwardly from two lateral sides of the bottom edge of the retaining portion 22 beside the junction of the retaining portion 22 with the base portion 24. A gap 28 is defined between the base portion 24 and each projection 25.

In assembly, the two boardlocks 20 are secured to the two side faces 18 of the insulative housing 12 by extending the retaining portions 22 into the two grooves 36, respectively, from the bottom of the housing 12 to reach a position in which the top edges 261 of the wings 26 engage with the board-mounting face 17 of the housing 12, and a top edge (not labeled) of the retaining portion 22 is substantially flush with top edges (not labeled) of the first and second retention blocks 32, 34.

The barbs 23 extend into the side channels 321, 341 and interferentially engage with the first and second retention blocks 32, 34. Since each first and second retention block 32, 34 has an elongated configuration along the assembling direction of the boardlock 20 to the housing 12, disengaging the barbs 23 from the housing requires the boardlocks 32, 34 to move a relatively long distance, which ensures that the boardlocks 32, 34 are securely retained in the housing 12. Furthermore, the engagement between the wings 26 and the board-mounting face 17, guarantees a horizontal orientation of the base portion 24, even when the base portion 24 is subjected to an upward bending force. Thus, a good quality soldered connector to the printed circuit board is ensured. The boardlocks of the present invention are vertically mounted to side faces of the housing, which facilitates assembly.

Finally, particularly referring to FIG. 2, a space 40 is defined between each base portion 24 and the board-mounting face 17 for cooling the base portion 24 during the soldering process by transmitting heat into the air in the space 40. The base portion 24 of each boardlock 20 is surface mounted to a solder pad on the printed circuit board. The posts 27 are insertable into holes in the printed circuit board both for positioning the boardlocks 20 on the circuit board and for increasing the soldering area. Furthermore, the projection 25 and the gap 28 can also increase the reliability of the soldered connection by adsorbing wicking solder.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting on a printed circuit board, comprising:

a housing having a board-mounting face for mounting to the printed circuit board, two opposite side faces extendly upwardly from two sides of the board-mounting face, and a groove vertically defined in at least one of said side faces; and a boardlock comprising a retaining portion vertically received in the groove and interferentially engaging with the housing, a base portion perpendicularly extending from a lower portion of the retaining portion to a position beneath the board-mounting face, and including a post downwardly extending from the base portion for extending through the printed circuit board, and at least one wing extending upwardly from the base portion for abutting against the board-mounting face; wherein a pair of projections extends downwardly from opposites sides of lower portion of the retaining portion; wherein a gap is defined between the base portion and the projections.

2. The electrical connector as claimed in claim 1, wherein the wing abuts against the board-mounting face by a top edge thereof.

3. The electrical connector as claimed in claim 1, wherein a space is defined between the base portion of the boardlock and the board-mounting face of the housing.

4. The electrical connector as claimed in claim 1, wherein the at least one groove is defined between two retention blocks formed on the at least one of the said side faces of the housing.

5. The electrical connector as claimed in claim 4, wherein the at least one groove is T-shaped as viewed from a top of the housing and has two side channels extending into the blocks, respectively.

6. The electrical connector as claimed in claim 5, wherein a plurality of barbs are formed on lateral edges of an upper portion of the retaining portion of the boardlock, said barbs extending into the side channels and having an interferential engagement with the blocks.

7. A modular jack connector, comprising;

a housing having a bottom board-mounting face adapted for mounting to a printed circuit board, two side faces vertically upwardly extending from the board-mounting face, and a cavity adapted to receive a complementary modular plug therein;

a number of contacts fixed in the housing, each contact having a contacting section upwardly and rearwardly extending into the cavity space, and a tail section for surface mounting to the printed circuit board;

a pair of boardlocks each having a retaining portion vertically secured to a corresponding side face of the housing, a base portion perpendicularly extending from a lower portion of the retaining portion to a position beneath the board-mounting face for surface mounting to the printed circuit board, a post projecting downwardly from the base portion for extending through the circuit board, and a pair of wings projecting upwardly from the base portion for engaging with the bottom board-mounting face of the housing; wherein a pair of projections extends downwardly from opposite sides of the lower portion of the retaining portion.

* * * * *